United States Patent [19]

Steingroever et al.

[11] Patent Number: 4,529,954

[45] Date of Patent: Jul. 16, 1985

[54] MAGNETIZING APPARATUS FOR ANISOTROPIC PERMANENT MAGNETS

[76] Inventors: Erich Steingroever, 53 Bonn, Flensburger Strasse 33, Bonn; Dietrich Steingroever, Bergisch-Gladbach, both of Fed. Rep. of Germany

[21] Appl. No.: 586,692

[22] Filed: Mar. 6, 1984

Related U.S. Application Data

[63] Continuation-in-part of Ser. No. 425,176, Sep. 28, 1982, Pat. No. 4,470,031, and a continuation-in-part of Ser. No. 332,330, Dec. 18, 1981.

[30] Foreign Application Priority Data

Oct. 18, 1983 [DE] Fed. Rep. of Germany ..... 3337761

[51] Int. Cl.[3] ..... H01F 13/00

[52] U.S. Cl. ..... 335/284; 335/302; 361/147

[58] Field of Search ..... 335/284, 302; 361/143, 361/146, 147, 148

[56] References Cited

U.S. PATENT DOCUMENTS

| | | | |
|---|---|---|---|
| 3,158,797 | 11/1964 | Andrews | 335/284 |
| 3,335,377 | 8/1967 | Kohlhagen | 335/284 |
| 3,461,350 | 8/1969 | Rioux | 361/143 |
| 3,678,436 | 7/1972 | Herdrich et al. | 335/284 |
| 4,162,470 | 7/1979 | Smith . | |

FOREIGN PATENT DOCUMENTS

| | | | |
|---|---|---|---|
| 2533950 | 6/1977 | Fed. Rep. of Germany | 335/284 |

*Primary Examiner*—George Harris

*Attorney, Agent, or Firm*—Fisher, Christen & Sabal

[57] ABSTRACT

A device for magnetizing multipolar permanent magnet bodies employs a supporting structure comprising a series of superimposed sheets of electrically insulating material, which may be of fiberglass, with prepared apertures to receive an electrically conductive magnetizing winding; the apertures may be arranged to firmly support the winding to prevent displacement despite the strong magnetic fields generated by a high current impulse discharge, and the winding can be arranged to produce a variety of polar patterns, by providing a suitable opening in the supporting structure on cylindrical magnets. The supporting structure includes at least one plate having a plurality of magnetic poles disposed about the inner perimeter of its aperture. This plate permits alignment of a previously magnetized body, that is not presently magnetized but which has magnetic domains therein in a pattern corresponding to its previous magnetization, with the magnetic poles of the apparatus such that efficient re-magnetization occurs corresponding to the preferred direction of magnetization of the body.

7 Claims, 4 Drawing Figures

MAGNETIZING APPARATUS FOR ANISOTROPIC PERMANENT MAGNETS

CROSS-REFERENCE TO OTHER APPLICATIONS

This application is a continuation-in-part of the copending U.S. applications, Ser. No. 06/425,176, filed Sept. 28, 1982, now U.S. Pat. No. 4,470,031 and Ser. No. 06/332,330, filed Dec. 18, 1981, the disclosures of which are incorporated herein by reference.

BACKGROUND OF THE INVENTION

The present invention concerns a multipolar magnetizing device for permanent magnets, which is used for the magnetization of highly coercive magnets, such as those made of Alnico, hard ferrite, or rare-earth-cobalt alloys.

Such magnets are known to be magnetized primarily with a high current pulse through a current conductor which is arranged opposite the surface of the magnet, the current conductor having the desired number of poles and the desired pole arrangement. Thus, it is possible to generate poles on the circumference of cylindrical permanent magnets or on flat surfaces, such as the end face of annular magnets.

Known magnetizing devices consist, for example, of a soft iron body with grooves which are arranged so as to have the desired pole pitch and into which high current capacity conductors are inserted. These conductors must be insulated adequately to prevent electrical conduction with the soft iron conductor, whereby a considerable portion of the available space in the grooves is occupied by the insulation. This is especially true in the case of narrow pole pitches. In addition, it is difficult to sufficiently secure the current conductors against strong mechanical forces, despite attempts such as pouring plastic into the grooves.

Furthermore, no provision is made in the prior art for aligning magnet bodies having a preferred direction of magnetization. Such bodies are created by initially magnetizing them, then completely demagnetizing them during further processing operations (for example, during sintering of a body formed of prepressed parts or grinding of the outside diameter of a cylindrical magnet body). Re-magnetization is less efficient if the magnet body is not properly aligned so as to be remagnetized according to its preferred direction of magnetization.

BRIEF SUMMARY OF THE INVENTION

The present invention avoids these difficulties and makes it possible to prepare magnetizing devices in a simple manner even with a narrow pole pitch in which the poles are closely spaced, and even in which the body to be magnetized already has a preferred direction of magnetization which must be properly aligned relative to a fixed magnetizing arrangement for efficient magnetization.

This is accomplished according to the present invention by provision of a body through which conductors pass for magnetizing a body having a preferred direction of magnetization. The preferred direction of magnetization is due to the orientation of the magnetic domains in the body.

The present invention relates to a multipole magnetizing arrangement for anisotropic permanent magnets. Such magnets are, for example, cylindrical rotary magnets with poles lying on the cylinder surface for motors, especially magnets used for synchronous motors and stepping motors.

A magnetizing arrangement for permanent magnets is described in the German patent application No. P 32 14 176.9, which corresponds to U.S. patent application Ser. No. 425,176, referred to in the above, and which has a high intensity conductor for producing the poles. This conductor is wound through bores of a body made of an insulating material or substance and lying in correspondence to the desired producing pole arrangements, the insulating material body being assembled from plates. Between the conductor bores in the insulating body, magnetically permeable parts such as parts consisting of soft iron may be disposed.

The invention relates to the latter characteristic of the cited patent application, Ser. No. 425,176. It consists in the fact that the body or at least one of the plates of which the magnetizing arrangement is composed, consists of a permanent magnetic working material having the property of being electrically insulating. Such a body is, for example, a permanent magnet of the type of barium-ferrite, preferably such one with a synthetic binder. The latter has the advantage that it may be processed easily so that the bores for the high intensity conductor may be made easily.

The magnetizing apparatus according to the present invention is very useful in the case of the magnetization of multipolar anisotropic permanent magnets. The latter have magnetic preference directions from pole to pole originating during production, and they have either in addition a magnetization or have been completely demagnetized for the purpose of further processing (for example, grinding of the outside diameter).

For re-magnetizing the processed magnets up to saturation, it is necessary to put them in the magnetizing apparatus into the correct positions, that is, corresponding to their magnetic directions of preference. The directions of preference are, for example, shown in FIG. 1 in a broken line from N to S. The magnets assume these positions by themselves whenever the magnetizing arrangement has an equal four-pole magnetic field as is the case in the present manufacturing apparatus described hereunder.

DETAILED DESCRIPTION OF THE INVENTION

Figure 1:
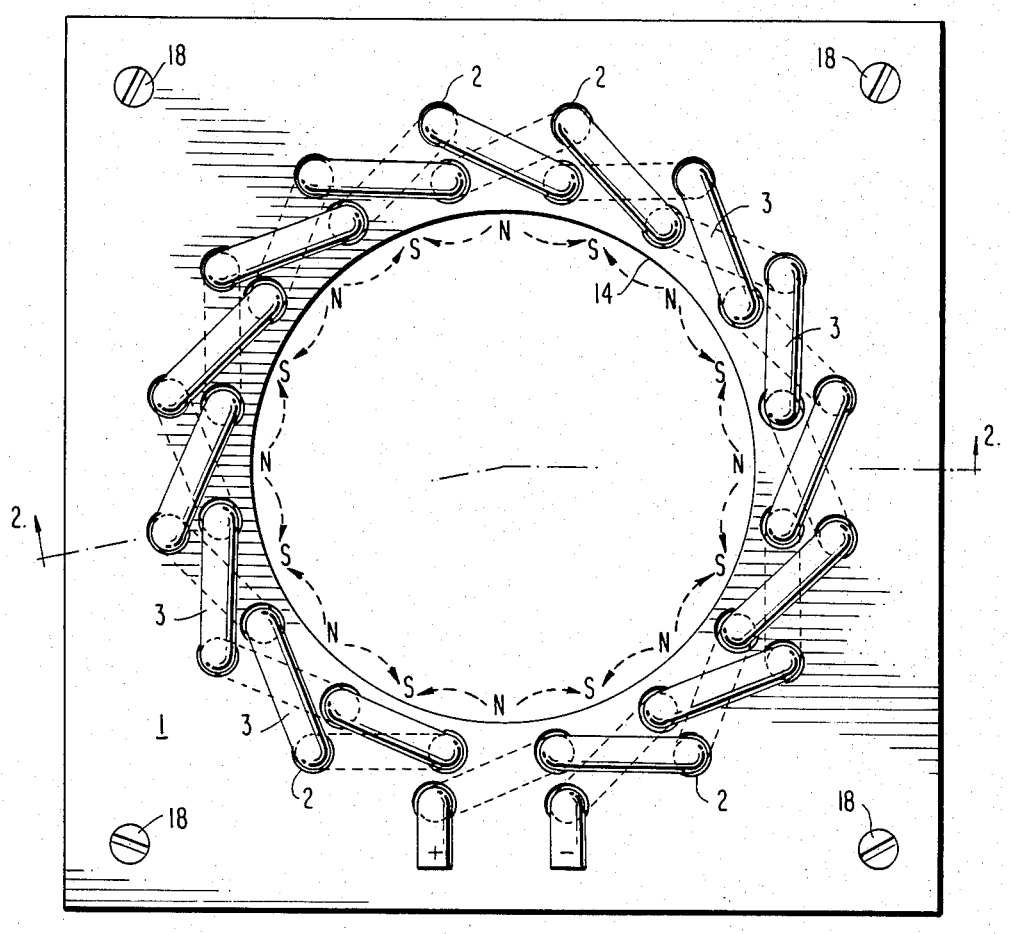
FIG. 1 is a plan view of a preferred form of a 16-pole magnetizing apparatus according to the invention for magnetizing a cylindrical permanent magnet.

FIG. 1 shows a top view of a 16-pole magnetizing apparatus for cylindrical anisotropic permanent magnets. The device is especially useful for magnetizing bodies which already have oriented magnetic domains, the apparatus described hereunder causing proper alignment of the cylindrical body to be magnetized with the poles of the apparatus such that the cylindrical body is magnetized along the preferred directions of magnetization which exist due to the previously existing magnetic domain orientation.

A supporting body 1 in accordance with the present invention carries the current conductors 3 and is composed of an electrically insulating material, especially a material that is reinforced with glass fibers. Numeral 2 indicates a series of bores in the electrically insulating body, which are distributed according to the desired pole arrangement, while numeral 3 indicates the high current conductor wound in a meandering shape from + to −, which generates the poles N and S on the outer surface of a permanent magnet body (not shown) arranged in the cylindrical opening 14 provided in body 1 during current flow. The cylindrical body to be magnetized is sized to be snugly received in opening 14.

In the type of winding shown in FIG. 1, an axial field is avoided. The windings are pulled through the bores, which are separated and electrically insulated from one another, with the result that the magnetizing device can be operated with high voltage in the range of 2,000 volts.

Figure 2:
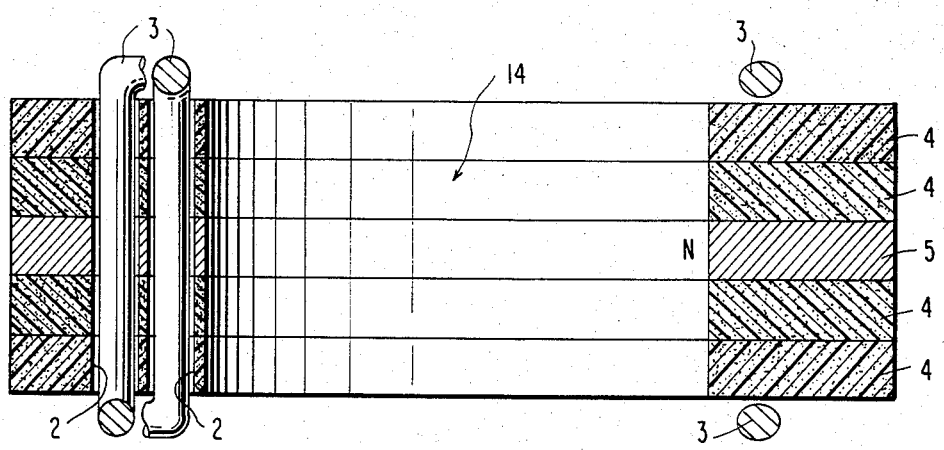
FIG. 2 is a side view in section taken along line A-B in FIG. 1.

The plates 4 of electrically insulating material forming the body are shown in stacked, assembled relationship in FIG. 2. Also shown in FIG. 2 assembled among the plates 4 is a plate 5 consisting according to the invention of a permanently magnetic working material or substance having the poles designated in dotted paths in FIG. 1 by N and S of which, in cut A-B in FIG. 2, only the pole N is visible. The plate 5 serves to orient a cylindrical body to be magnetized according to the magnetic preferred direction of magnetization of the cylindrical body due to the presence of oriented magnetic domains already existing in the cylindrical body due to a premagnetizing operation. Other operations, such as grinding or sintering, then destroy the magnetization without, however, disturbing the orientation of the magnetic domains and thus the body to be re-magnetized by the apparatus of the present invention has a preferred direction of magnetization. According to the invention, the plates 4 bearing the current conductors 3 may also consist of a massive working material of the kind comprising barium-ferrite, with holes 2 for receiving the current conductors shown in FIG. 1. However, it will also be possible to use metallic working substances, the bores of which are electrically insulated against the current conductor.

Figure 3:
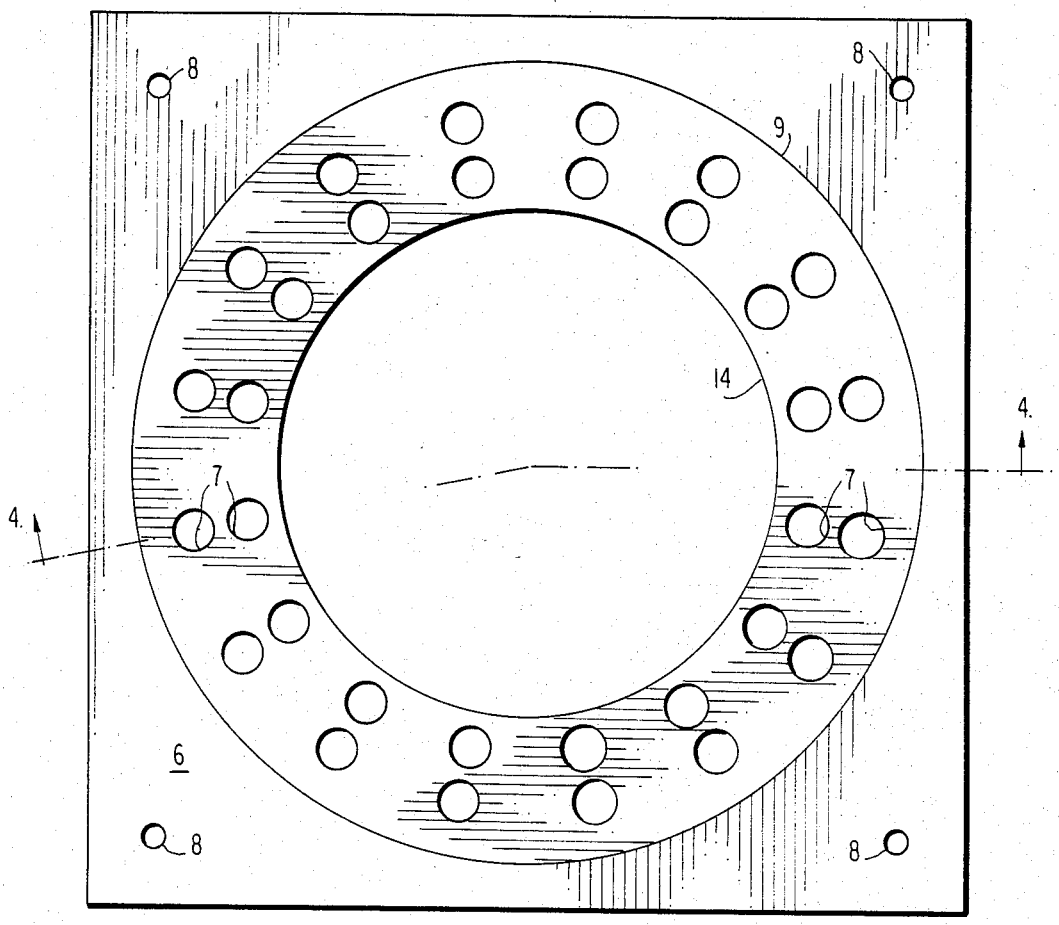
FIG. 3 is a top elevational view of a single plate corresponding in shape to any of plates 4,5 in FIGS. 1 and 2, but having a composite construction of a magnetic and a non-magnetic material.
Figure 4:
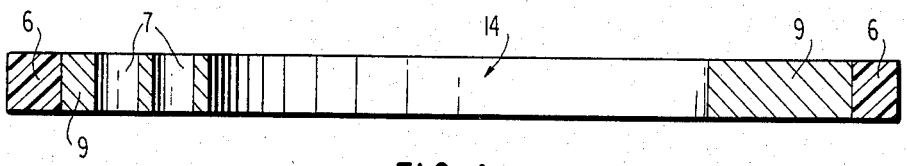
FIG. 4 is a side sectional view taken along the line C-D in FIG. 3.

In FIG. 3, a single plate 6, similar in shape to plates 4 of FIG. 1 but being of a composite material, from which the magnetizing apparatus according to the invention can be composed, is shown in top view and in FIG. 4 in section. Plates 4 and 5 of FIGS. 1,2 are shaped identically to that of plate 6 of FIGS. 3,4. Bores 7 are formed in plate 6 to receive the current conductors 3 (as illustrated by FIGS. 1,2). Four bores 8 are shown in FIG. 3 for receiving screws 18 for assembling the plates together as shown in FIG. 1.

FIG. 4 is a sectional side view taken along lines C-D of FIG. 3.

According to the invention, at least one of the plates or discs consists of a permanent magnetic working material. But it is also possible that only a part of it consists of said working material, for example, a circular disc 9 which is sunk into a nonmagnetic plate 6.

A special advantage of the high voltage capacity of the present apparatus according to the invention (and high intensity capacity of the conductors 2) lies in the fact that in the case of connecting the apparatus with an impulse magnetizing device, one need pay no attention to the polarity of the connections, because the polarization of the magnetizing arrangement is accomplished automatically corresponding to the pertinent direction of the current and therefore anisotropic permanent magnets still premagnetized (as discussed hereinabove) from the time of the production align themselves correctly automatically.

While preferred embodiments are shown, it will be understood that the present invention is not limited thereto but may be otherwise embodied within the scope of the following claims.

What is claimed is:

1. A magnetizing arrangement for anisotropic permanent magnets comprising: a high intensity electrical conductor for producing magnetic poles in a magnetizable member, said magnetizable member being in an unmagnetized state but having a preferred direction of magnetization due to the presence of oriented magnetic domains already existing in said magnetizable member; said magnetizable member being received in a body of insulating material arranged corresponding to a predetermined pole arrangement, said insulating body including a permanently magnetic portion; whereby said permanently magnetic portion aligns said magnetizable body according to said predetermined pole arrangement due to said preferred direction of magnetization of said magnetizable body.

2. A magnetizing arrangement as in claim 1, wherein the body is composed of several plates of which at least one includes a permanently magnetic working substance.

3. A magnetizing arrangement for anisotropic permanent magnets comprising a high intensity conductor for producing the poles, which is received in a body of insulating material arranged corresponding to the pole arrangement to be produced, said body including a permanently magnetic portion;

said body being composed of a plurality of plates of which at least one includes a permanently magnetic working substance;

said body including an electrically magnetic working substance.

4. A magnetizing arrangement as in claim 3, wherein said permanently magnetic working substance includes barium-ferrite with a synthetic binder.

5. A magnetizing arrangement as in claim 3, wherein the permanently magnetic working substance includes massive barium-ferrite.

6. A magnetizing arrangement as in claim 3, wherein the permanently magnetic working substance includes a permanently magnetic ferrite which is related to massive barium-ferrite.

7. A magnetizing arrangement for an anisotropic permanent magnets comprising:

a high intensity electrical conductor for producing magnetic poles in a magnetizable member;

said magnetizable member being in an unmagnetized state but having a preferred direction of magnetization due to the presence of oriented magnetic domains already existing in said magnetizable member;

said magnetizable member being received in a body of insulating material arranged corresponding to a predetermined pole arrangement;

said insulating body including a permanently magnetic portion;

said body being composed of a plurality of plates, of which at least one of said plurality of plates includes a permanently magnetic working substance; and said body including an electrically insulating magnetic working substance.

* * * * *